United States Patent [19]

Lyons

[11] Patent Number: 4,602,587

[45] Date of Patent: Jul. 29, 1986

[54] FLOAT STRUCTURE

[76] Inventor: Frank J. Lyons, 205 Graf, Bozeman, Mont. 59715

[21] Appl. No.: 642,878

[22] Filed: Aug. 21, 1984

[51] Int. Cl.[4] ..... B63B 35/44

[52] U.S. Cl. ..... 114/264; 114/125; 114/266; 114/267

[58] Field of Search ..... 114/263, 264, 266, 267, 114/125; 441/35; 405/219

[56] References Cited

U.S. PATENT DOCUMENTS

| | | | |
|---|---|---|---|
| Re. 24,837 | 6/1960 | Usab | 405/219 X |
| 650,333 | 5/1900 | Martens | 114/125 |
| 3,789,446 | 2/1974 | Rudelick | 114/264 X |
| 3,857,352 | 12/1974 | Schott | 114/267 X |

*Primary Examiner*—Sherman D. Basinger

*Attorney, Agent, or Firm*—Arthur L. Urban

[57] ABSTRACT

A float structure includes a flotation portion, a frame portion, a shell portion and a connector portion. The flotation portion includes a unitary porous slab member having a generally quadrangular configuration and includes upper and lower major faces and sidewalls joining same. The sidewalls taper inwardly toward the lower major face thereof. The frame portion includes a plurality of elongated interconnected strip members disposed around the periphery of the slab member adjacent the upper major face thereof. The shell portion includes a continuous waterproof covering over substantially the entire outer surface of the flotation portion. The connector portion includes a plurality of spaced fasteners extending through the shell portion into the frame portion and capable of securing bracket members to the periphery of the structure; whereby the float structure may be carried to a body of water and anchored therein at a desired location.

20 Claims, 5 Drawing Figures

FLOAT STRUCTURE

This invention relates to a novel float structure and more particularly relates to a new and improved portable float structure.

Throughout history, man has utilized a wide variety of structures to cross bodies of water. Originally, these structures were pieces of wood or trunks of trees. Later, tree trunks were lashed together to form rafts which could handle larger loads.

As society developed, boats were fabricated from the wood to provide craft that could move through the water more rapidly and could carry cargo with less risk of it getting wet. More recently, marine motors were developed so the watercraft could be moved more easily.

The increased use of watercraft also created a need for docking facilities. Conventional boat docks ordinarily are fixed structures that are formed by driving piles (poles) into the bottom of a body of water and then building a platform thereon above the level of the water.

While such docks perform satisfactorily, they are not without their problems. First of all, they are very expensive to construct and to maintain. Driving the piles into the river or lake bottom requires special equipment and considerable material to achieve a rigid foundation.

Furthermore, since these docks are permanent structures, they are exposed to adverse weather and water conditions including salt or ice conditions. This can cause rapid deterioration and damage to the dock in a relatively short period of time. This destruction can only be prevented by regular extensive maintenance involving considerable time and major expenditures.

In an attempt to overcome the shortcomings of the above docks, floating docks have been developed. These docks are structures that float on the surface of the water and are only anchored to maintain their position. The docks rise and fall with the water level and can be removed from the water during winter to prevent ice damage.

Floating docks commonly are platforms with flotation means under the deck such as metal drums filled with air and the like. Although such docks overcome many of the deficiencies of permanent docks, they also have problems. The platform sections are heavy and cumbersome to handle. In an attempt to solve these problems, it has been proposed to employ undercarriages with wheels so the sections can be pulled onto the shore more easily.

It also has been proposed to utilize aluminum for the deck and frame sections and foams as the flotation materials. The use of such materials decreases the weight of the structures to a degree, but they still are difficult to handle although less so than the former structures.

It is clear from the above discussion that past and present dock and platform structures do not provide a desirable solution for some purposes and needs. Thus, there is a need for a new and improved float structure that can overcome the deficiencies of previous structures.

The present invention provides a novel float structure with features and advantages not found in earlier structures. The float structure of the invention is light in weight and durable in construction. The float can be carried to a body of water easily on the top of a car or other vehicle and then transferred to the water by hand with a minimum of effort.

After the float structure of the invention is placed into the water it can be pushed or towed to a desired location. It can then be anchored or tied to another structure for use. The float structure is stable in the water and can be employed for a variety of different uses including rafts, dock sections, diving platforms and the like.

The float structure of the present invention is simple in design and can be produced relatively inexpensively. Commercially available materials and components can be utilized in its fabrication. Conventional industrial manufacturing techniques and procedures can be employed in the production thereof.

The float structure of the invention can be used efficiently by adults of normal strength and stamina after only a minimum of instruction. The structure can be modified with a variety of accessories such as ladders, railings, carpeting, connectors and the like. The structure is durable in construction and has a long useful life. Little, if any, maintenance is required to keep the structure in good working condition.

These and other benefits and advantages of the novel float structure of the present invention will be apparent from the following description and the accompanying drawings in which.

Figure 1:
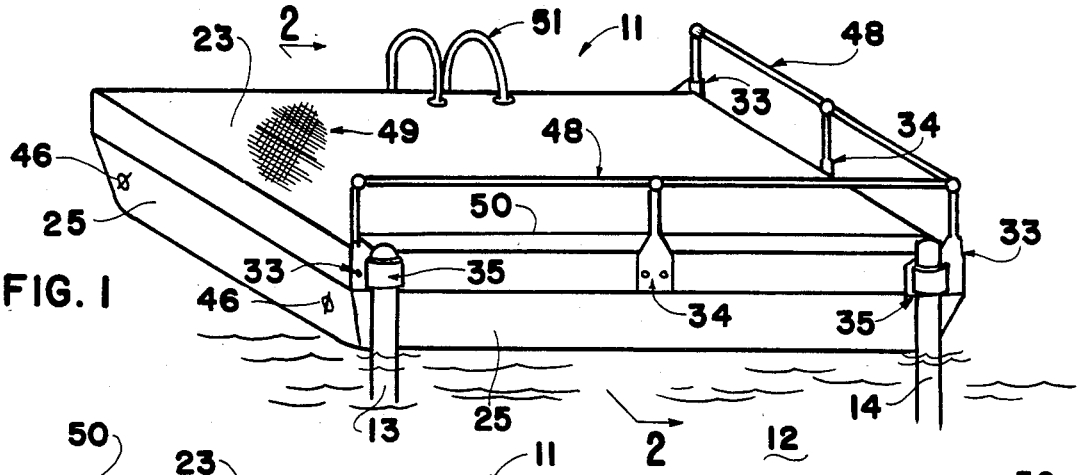
FIG. 1 is a view in perspective of one form of the float structure of the invention in use.
Figure 2:
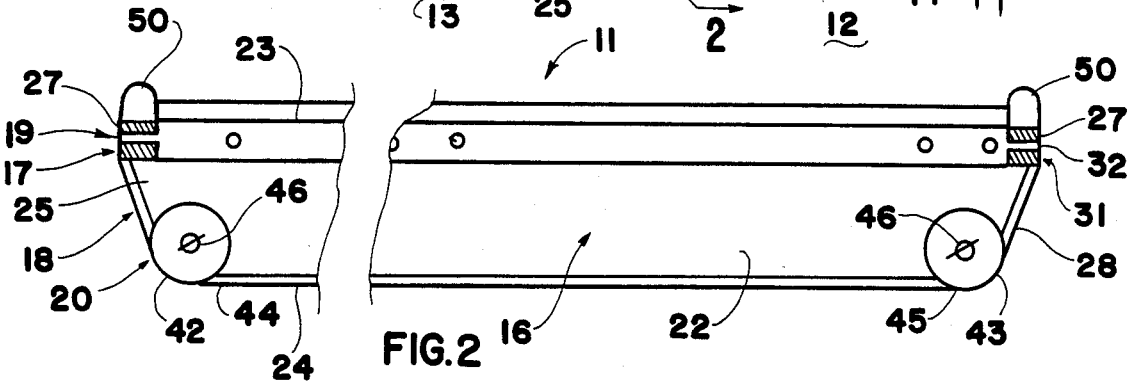
FIG. 2 is a sectional view of the float structure shown in FIG. 1 taken along line 2—2 of FIG. 1.
Figure 3:
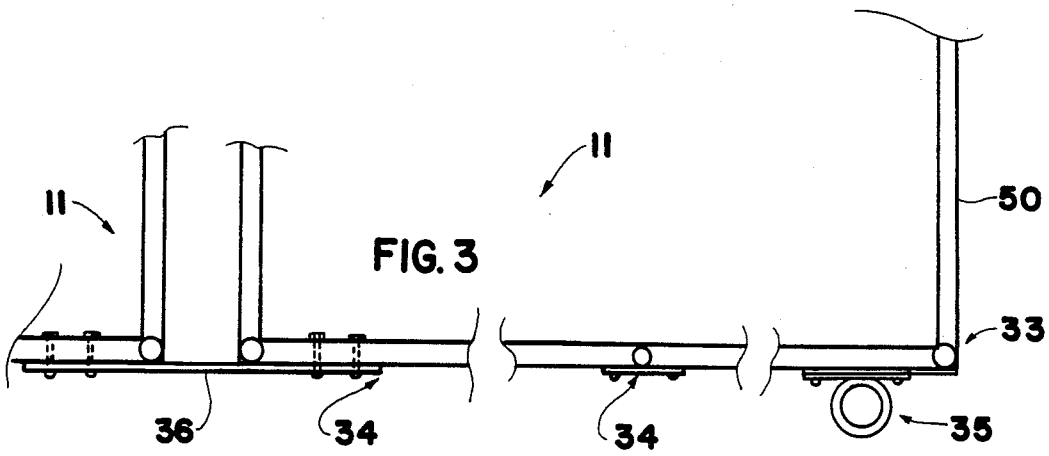
FIG. 3 is an enlarged fragmentary top view of the float structure shown in FIG. 1 joined to a second float structure.

As shown in the drawings, one form of the novel float structure 11 of the present invention is floating on a body of water 12. The structure 11 is attached to piles 13 and 14 to hold its position in the water. The float structure 11 of the invention includes a flotation portion 16, a frame portion 17, a shell portion 18 and a connector portion 19. Advantageously, the structure also includes a ballast portion 20.

The flotation portion 16 of the float structure 11 of the present invention includes a unitary porous slab member 22. The slab member 22 has a generally quadrangular configuration. The slab member includes an upper major face 23 and a lower major face 24. Sidewalls 25 join the upper and lower major faces 23 and 24. The sidewalls 25 taper inwardly from the upper face 23 toward the lower face 24. Advantageously, the slab member 22 is formed of a foam material such as a polyurethane.

The frame portion 17 of the float structure 11 of the invention includes a plurality of elongated interconnected strip members 27. The strip members 27 are disposed around the periphery of the slab member 22. The strip members are disposed adjacent the upper major face 23 thereof. The strip members 27 advantageously have a generally quadrangular cross section. Preferably, the strip members are formed of wood.

The shell portion 18 of the float structure 11 includes a continuous waterproof covering 28 over substantially the entire outer surface of the flotation portion 16 and the frame portion 17. The waterproof covering 28 advantageously completely covers the outer surface of the flotation portion in one or more sections. Preferably, the waterproof covering is a plastic coating. The plastic coating may be a fiberglass-reinforced epoxy plastic coating or may be a coating of a thermoplastic polymer such as a polyolefin, a polyvinyl, a polyamide, a polyester or the like.

Figure 4:
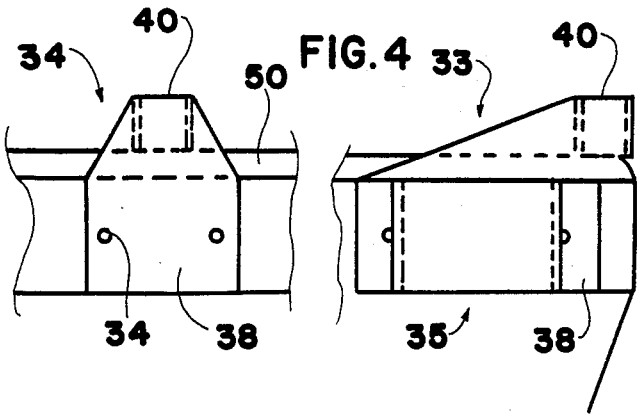
FIG. 4 is a fragmentary side view of the float structure shown in FIG. 1.
Figure 5:
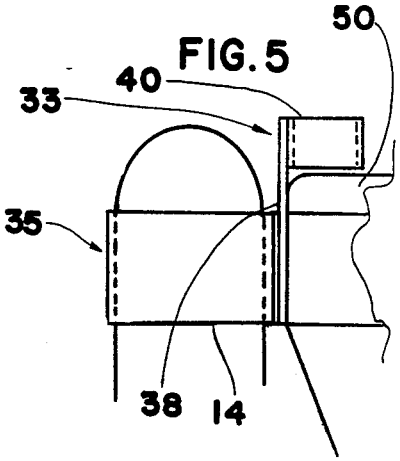
FIG. 5 is a fragmentary right corner view of the float structure shown in FIG. 4.

The connector portion 19 of the float structure 11 includes a plurality of spaced fastening means 31. The fastening means 31 shown as recessed "Tee" nuts 32 extend from the outer surface of shell portion 18 into the frame portion 17. The fastening means 31 are capable of securing bracket members 33, 34 and 35 to the structure or for connecting several structures 11 with couplers 36 as shown in FIG. 4.

The bracket members 33, 34 and 35 advantageously are secured to the fastening means 31 around the periphery of the upper major face 23 of the structure. Each of the bracket members preferably includes a mounting section 38 with openings 39 that can be aligned with the fastening means. Also, the bracket member includes a vertically oriented socket section 40. The socket section 40 extends from the mounting section 38, preferably offset from a plane through the mounting section.

The float structure 11 of the present invention also advantageously includes a ballast portion 20. The ballast portion 20 may include elongated hollow members 42 and 43. These hollow members preferably are disposed along opposite edges and particularly longitudinal edges 44 and 45 of the lower major face 24 of the slab member 22. Advantageously, the ballast portion also includes an inlet opening 46 for each hollow member. The hollow members 42 and 43 preferably are tube members as shown in the drawings.

The bracket members 33–35 of the float structure of the invention as shown in the drawings may include corner brackets 33 with sockets 38 for fence sections 48 extending upwardly therefrom. The brackets are disposed along edges of the upper major face 23 of the structure. To provide additional stability for the fence sections, a bracket member 34 may be utilized intermediate the corner brackets 33. Brackets 35 are included for securing the float structure 11 to piles 13 and 14.

To maximize use of the float structure, accessories such as carpeting 49 may be disposed over the upper major face 23. Also, grab rails 50 may be included around the periphery of the upper major face 23 and affixed to the frame portion 17. In addition, a ladder 51 may be disposed along one sidewall of the structure and affixed adjacent the periphery of the upper major face 23.

In the use of the float structure 11 of the present invention as shown in the drawings, the structure can be transported to a body of water 12 on the top of a car or in a truck conveniently since it is light in weight. Upon arriving at the water, the structure is lifted off the vehicle and carried to the edge of the water. At that time, the fencing sections 48 are inserted into socket sections 40 of the brackets 33 and 34. Also, the ladder may be mounted on an edge of the upper face 23. In addition, the inlet openings 46 of the tube members 42 and 43 are opened, allowing water to add ballast to the structure.

The float structure 11 then is anchored in position. This can involve securing the structure to piling 13 and 14 along the shore to provide a dock section. In this case, additional structures 11 may be connected to the first float structure 11 through the connector portions 19. The combined float structures thus provide a floating dock assembly that can be removed from the water easily for storage.

Alternatively, the float structure can be pushed by hand or towed with a boat to a location away from the shore and anchored either by attachment to a pile 13 or simply by dropping a line anchor (not shown).

The above description and the drawings show that the present invention provides a novel flat structure with a combination of features and advantages not found in previous structures. The float structure of the invention is light in weight and can be transported to a body of water on the top of a vehicle and then carried to the shore by hand. All of this can be accomplished, depending upon the size of the float structure, by one or more adults with normal strength and stamina.

The float structure of the invention is simple in design and can be produced relatively inexpensively using commercially available materials and conventional fabrication techniques. The structure is durable in construction and has a long useful life with little maintenance.

After being placed into the water, the float structure of the invention can be secured to the shore as a section of a floating dock or can be pushed by hand or towed to a location off shore for use as a raft; a swimming, sunning or diving platform and similar uses.

It will be apparent that various modifications can be made in the particular float structure described in detail above and shown in the drawings within the scope of the invention. The size, configuration and arrangement of components can be changed to meet specific requirements. The slab member may be an assembly of porous components and include stiffeners if desired. Also, other accessories may be utilized. These and other changes can be made in the float structure of the present invention provided the functioning and operation thereof are not adversely affected. Therefore, the scope of the present invention is to be limited only by the following claims.

What is claimed is:

1. A float structure including a flotation portion, a frame portion, a shell portion and a connector portion; said flotation portion including a unitary porous slab member having a generally quadrangular configuration, said slab member including substantially flat upper and lower major faces and substantially flat sidewalls joining same, said sidewalls tapering inwardly toward said lower major face thereof; said frame portion including a plurality of elongated interconnected strip members, said strip members being disposed around the periphery of said slab member adjacent said upper major face thereof and recessed therein to provide smooth outer surfaces; said shell portion including a continuous waterproof covering over substantially the entire outer surface of said flotation portion and said frame portion; said connector portion including a plurality of spaced fastening means extending through said shell portion into said frame portion and capable of securing bracket members to the periphery of said structure; whereby said float structure selectively and repeatedly may be carried to a body of water and anchored therein at a desired location.

2. A float structure according to claim 1 including a ballast portion including elongated hollow tube members disposed along opposite edges of said lower major face of said slab member and recessed therein to provide smooth outer surfaces with an inlet opening for each of said tube members.

3. A float structure according to claim 2 wherein said elongated hollow members of said ballast portion are tube members.

4. A float structure according to claim 2 wherein said elongated hollow members are disposed along opposite longitudinal edges of said lower major face of a rectangular slab member.

5. A float structure according to claim 1 wherein said slab member is formed of a foam material.

6. A float structure according to claim 1 wherein said strip members have a generally quadrangular cross section.

7. A float structure according to claim 1 wherein said strip members are formed of wood.

8. A float structure according to claim 1 wherein said waterproof covering of said shell portion completely covers the outer surface of said flotation portion.

9. A float structure according to claim 1 wherein said waterproof covering is a plastic coating.

10. A float structure according to claim 9 wherein said plastic coating is a fiberglass-reinforced epoxy plastic coating.

11. A float structure according to claim 9 wherein said plastic coating is a thermoplastic polymer coating.

12. A float structure according to claim 1 wherein said connector portion includes a plurality of bracket members secured to said fastening means disposed around the periphery of said upper major face of said structure.

13. A float structure according to claim 12 wherein each of said bracket members includes a mounting section with openings alignable with said fastening means.

14. A float structure according to claim 13 wherein each of said bracket members includes a vertically oriented socket section extending from said mounting section.

15. A float structure according to claim 14 wherein said socket section is offset from a plane through said mounting section.

16. A float structure according to claim 12 including fence sections engageable with said bracket members.

17. A float structure according to claim 1 including grab rails disposed around the periphery of said upper major face and affixed to said frame portion.

18. A float structure according to claim 1 including a ladder disposed along one sidewall of said structure and affixed adjacent the periphery of said upper major face.

19. A float structure according to claim 1 including carpeting disposed over said upper major face.

20. A float structure according to claim 1 including a plurality of interconnected adjacent float structures.

* * * * *